US005427559A

United States Patent [19]

Glickman et al.

[11] Patent Number: 5,427,559

[45] Date of Patent: Jun. 27, 1995

[54] CHAIN DRIVE FOR CONSTRUCTION TOY SYSTEM

[75] Inventors: Joel I. Glickman, Huntingdon Valley; Alfred Neubauer, Langhorne; Ralph J. Boettcher, Quakertown, all of Pa.

[73] Assignee: Connector Set Limited Partnership, Hatfield, Pa.

[21] Appl. No.: 194,469

[22] Filed: Feb. 10, 1994

[51] Int. Cl.[6] ..... A63H 33/08

[52] U.S. Cl. ..... 446/103; 446/104; 59/85; 59/900; 474/156; 474/207

[58] Field of Search ..... 446/103, 104, 120, 102; 59/82, 85, 87, 78, 90, DIG. 900; 474/213, 217, 155, 156, 207

[56] References Cited

U.S. PATENT DOCUMENTS 566,230 8/1896 Schaefer et al. ..... 474/156
2,113,504 4/1938 Caute ..... 59/78 U X
2,810,297 10/1957 Drewrys ..... 59/85 X
3,946,515 3/1976 Fischer ..... 446/103

*Primary Examiner*—Mickey Yu
*Attorney, Agent, or Firm*—Schweitzer Cornman & Cross

[57] ABSTRACT

A chain drive mechanism, especially for a construction toy system, is assembled with individual U-shaped chain link elements. The chain link elements are notched at their open ends and provided with bearing portions at their closed ends. The notched open ends are arranged for snap-fit attachment over the bearing portions of adjacent links, enabling a flexible chain of any length to be easily assembled. Drive pins, preferably coaxial with the bearing portions, project outwardly from each side of the chain links and are engagable with grooves of spaced-apart drive wheels, collectively forming a sprocket assembly. The drive wheels can be individual gear elements otherwise used in a toy construction system for gear drive mechanisms. The base portions of the U-shaped link elements are grooved transversely for the snap-fit attachment of construction toy connector parts, allowing the chain elements to carry other components.

8 Claims, 4 Drawing Sheets

CHAIN DRIVE FOR CONSTRUCTION TOY SYSTEM

RELATED APPLICATIONS

This application is related to the subject matter of Glickman U.S. Pat. Nos. 5,049,105, 5,061,219 and 5,137,496, owned by Connector Set Limited Partnership, Hatfield, Pa. The disclosures of these patents are incorporated herein by reference.

BACKGROUND AND SUMMARY OF THE INVENTION

The present invention relates to a novel chain drive system for incorporation into a construction toy system, for use in driving movable parts located remotely from the drive input, for conveying elements from one location to another, etc. The drive system of the invention is most usefully incorporated in and combined with elements of the above mentioned Glickman patents.

The chain drive of the invention includes a novel chain link construction, in which each link, formed of injection molded structural plastic, is of a generally U-shaped configuration. The link element includes a pair of spaced-apart side elements, which are laterally notched adjacent their outer ends. The "base" portion of the U-shaped link has cylindrical bearing portions adapted for snap-in assembly with the notched side elements of an adjacent link. Once the snap-in assembly has been effected, the adjacent links are semi-permanently connected but can easily pivot about a transverse axis in the manner of a conventional link chain. The arrangement enables a drive chain to be assembled of any length suitable for the particular application. Disassembly is, of course, equally efficient. The chain structure is strong, extremely lightweight and, as will appear, highly versatile.

In a particularly preferred embodiment of the invention, each of the individual chain links, at its base, includes outwardly projecting drive pins at each side, axially aligned with the cylindrical bearings by which an adjacent link is connected. The spacing of adjacent sets of drive pins on successive links corresponds with the spacing between a predetermined number of teeth of a drive gear. In the preferred embodiment of the invention, a pair of such gears are mounted on a shaft in predetermined spaced-apart relation equal to the overall width of the chain links, as defined by the spaced-apart side elements. The respective gears are secured to a supporting shaft and provide a driving connection between the chain and the shaft. Opposed pairs of drive pins progressively seat in grooves, formed between successive teeth of the gears, providing a particularly advantageous form of driving connection between the chain and the gears.

In another preferred embodiment of the invention, the base portion of each chain link includes, in addition to the cylindrical bearing portions previously mentioned, a central coupling portion which is transversely grooved to accommodate snap-in assembly of a connector element of a type disclosed in the before mentioned U.S. patents. By assembling a connector element with selected links of a chain assembly, it is possible to provide additional driving functions, such as moving of parts on a conveyor structure, advancing vehicles up an incline for a roller coaster structure, etc.

For a more complete understanding of the above and other features and advantages of the invention, reference should be made to the following detailed description of a preferred embodiment of the invention and to the accompanying drawings.

DESCRIPTION OF PREFERRED EMBODIMENTS

Figure 1:
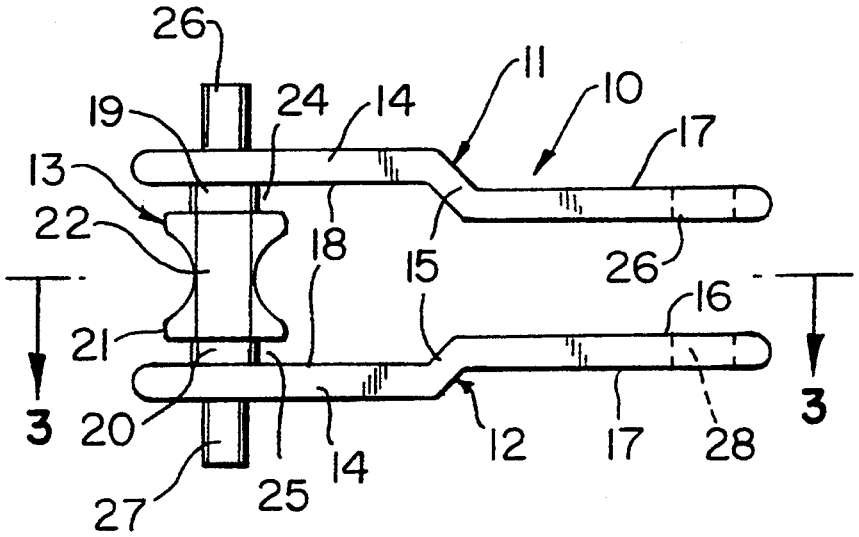
FIG. 1 is a top plan view of a new chain link element incorporating features of the invention.

Referring to the drawing, the reference numeral 10 designates generally a chain link element, injection molded of a structural plastic material, preferably polypropylene. The link 10 is of generally U-shaped configuration, including opposed, spaced-apart side elements 11, 12 rigidly joined at one end by an integral base element, designated generally by the reference numeral 13. The side elements 11, 12 are of generally thin, flat configuration each having a base end portion 14, an offset 15 and a projecting free end portion 16. The offsets 15 are configured so that the outer surfaces 17 of the free end portions 16 align substantially with the inner surfaces 18 of the base end portion of the link side walls. This is to facilitate end-to-end assembly of successive links, as will appear.

The base element of the U-shaped chain link 10 is molded integrally with and rigidly to the side elements 11, 12 and includes cylindrical bearing portions 19, 20 immediately adjacent the base end portions 14. Located between the bearing portions 19, 20 is a coupling element 21 formed on its top and bottom surfaces with coupling grooves 22. The coupling element is utilized for the attachment of external elements, as will be further described.

As is evident in FIG. 1, the coupling element 21 is axially aligned with the bearing portions 19, 20 and is of larger dimensions than the bearing portions. Accordingly, annular bearing grooves 24, 25 are defined between the side element inner walls 18 and the respective opposite end walls of the coupling element 21.

Drive pins 26, 27 project outwardly from the opposite sides of the chain link element, coaxial with the bearing portions 19, 20. The drive pins, as will be further described, are utilized to provide driving or driven association between the chain links and associated sprocket assemblies.

The outer free end portions 16 of the chain link are provided, adjacent their outer extremities, with circular openings 28 of a diameter closely approximating but just slightly larger than the diameter of the bearing portions 19, 20. For example, in a typical practical chain link element for a construction toy system, where the chain links are approximately one-half inch in width, and successive links have a center-to-center distance of approximately 0.9 inch, the bearing diameter may be chosen to be about 0.122 inch whereas the diameter of the openings 28 may be about 0.125 inch, providing a nominal 3 mil clearance. Along the bottom of the side element portions 16, the side elements are formed with a notch 29 extending from the bottom of the side element into the opening 28. The notch 29 usefully may be slightly convergently tapered approaching the opening 28, and has a throat dimension 30 slightly less than the diameter of the bearing portions 19, 20, for example a throat dimension of about 0.100 is useful with the example bearing diameters of 0.122.

A plurality of chain links 10 may be assembled end-to-end to form a flexible link chain by aligning the tapered notches 29 of one link with the respective bearing portions 19, 20 of a successive link, and pressing the outer end of the first link down over the bearing portions of the next link. The inherent elasticity of the plastic material allows the throat area 30 to open up wide enough to receive the bearing portions 19, 20, but then the throat recloses, so that the links are semi-permanently assembled; that is, they are permanently assembled until it is desired to disassemble them, at which time the links can be snapped apart in a manner which is the reverse of the assembly operations.

Figure 4:
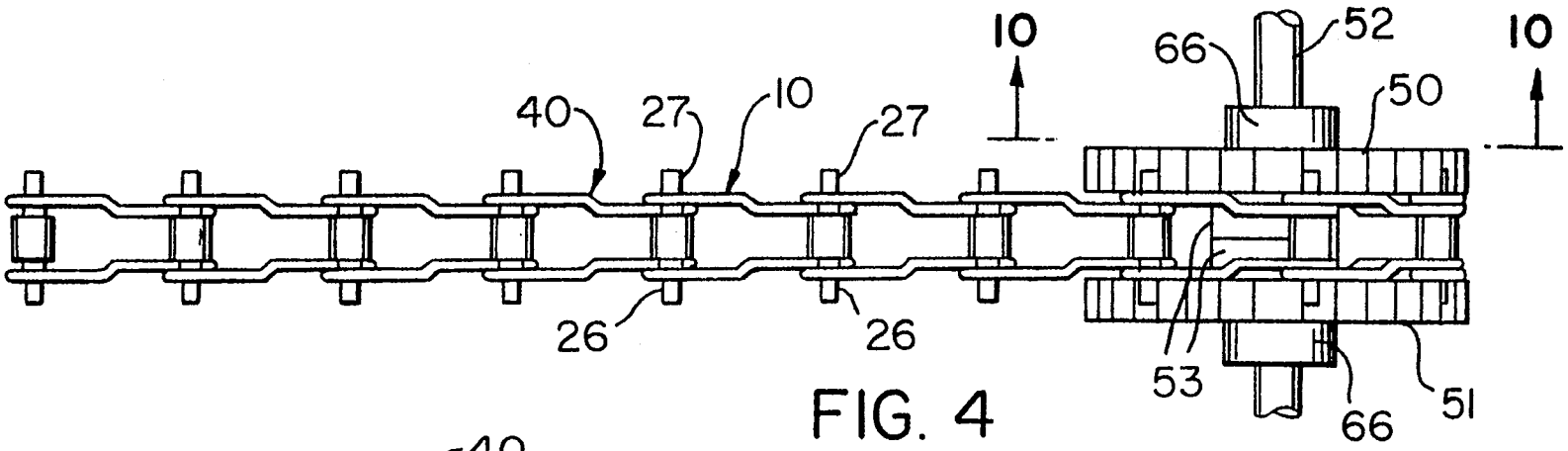
FIG. 4 is a fragmentary top plan view showing an assembled chain constructed of a plurality of the chain links of FIG. 1 arranged in driving or driven relation to a sprocket assembly.
Figure 5:
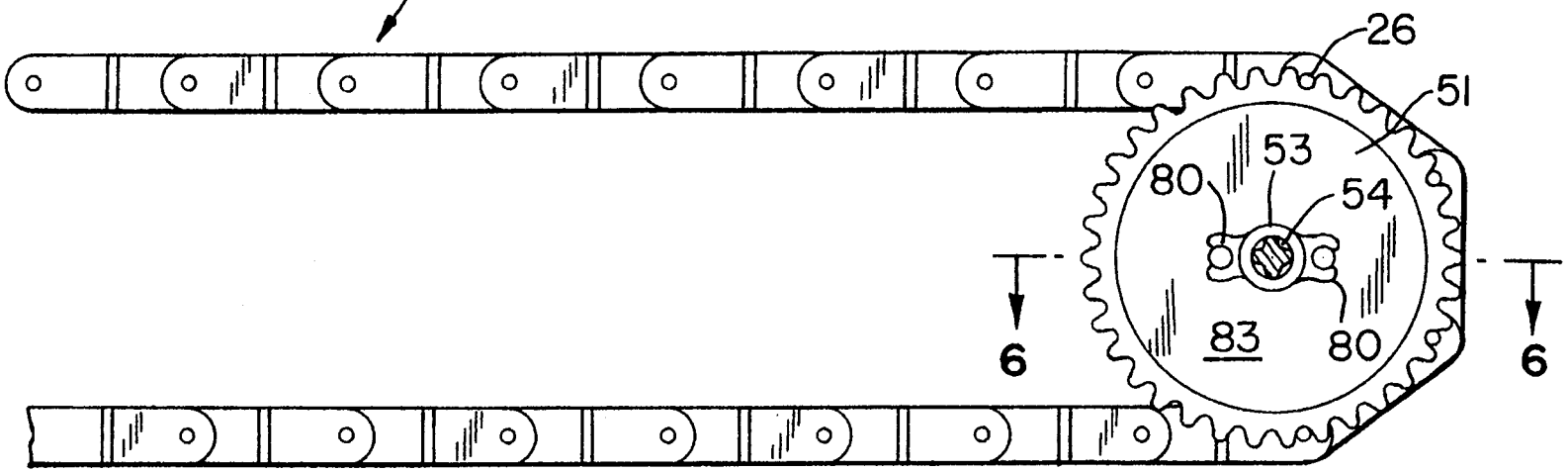
FIG. 5 is an elevational view of the assembly of FIG. 4.

With reference to FIGS. 4 and 5, there is shown an assembled chain 40, consisting of a series of the links 10 connected together in succession in the manner described. It will be understood, of course, that a typical chain assembly is of endless configuration although that is of course not necessary. The individual links of a chain assembly are freely pivotable one with respect to the other about the axis of the bearing portions, as will be understood.

Figure 11:
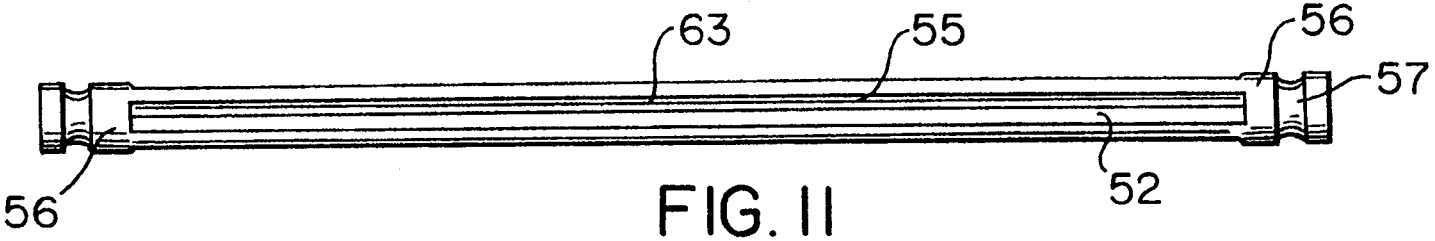
FIG. 11 is an elevational view of a strut-like construction toy element, useful as a sprocket mounting shaft in the chain drive of the invention.

A novel and advantageous driving system for the chain 40 comprises a pair of spur gears 50, 51 mounted in spaced-apart relation on a shaft 52. The spur gears 50, 51 advantageously are of a type described in copending application Ser. No. 072,271, owned by Connector Set Limited Partnership, Hatfield, Pa. The gears 50, 51 include a cylindrical hub 53 provided with a central opening for the slidable, rotatable reception of the shaft element 52. The shaft element 52 advantageously is of a type shown in FIG. 11, including an elongated, longitudinally grooved body section 55 of X-shaped cross section. At each end, there are generally cylindrical end portions 56, each provided with an annular locking groove 57. The X-shaped cross section of the body 55 is contained within the cylindrical envelope defined by the cylindrical opposite end portions 56. Such cylindrical envelope is just slightly smaller in diameter than the diameter of the opening 54 in the gear hub 53, so that the gear rotates and slides easily on the shaft 52.

Figure 6:
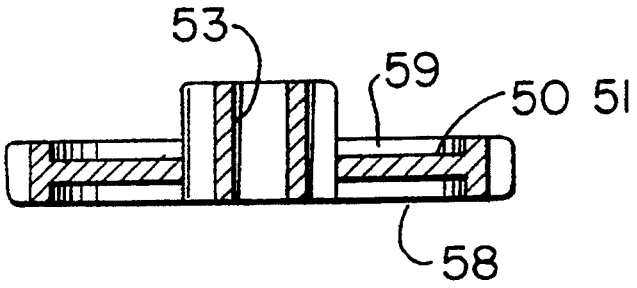
FIG. 6 is a cross sectional view, as taken generally on line 6—6 of FIG. 5, showing details of construction of a spur gear element forming part of a sprocket assembly.
Figure 7:
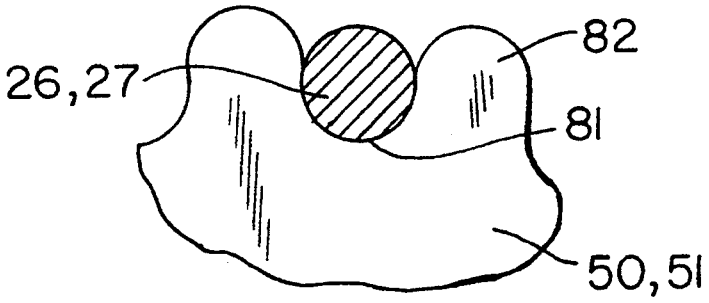
FIG. 7 is an enlarged fragmentary illustration of a portion of the sprocket assembly.

The hub 53, as shown in FIG. 6, may be and preferably is flush at one end with the plane 58 of one side of the gear while at the other side projecting well beyond the plane 59 of the gear at the opposite side. To particular advantage, the asymmetrical projection of the hub 53 beyond the plane 59 is equal to one half of the overall width of a chain link, as measured between outside surfaces of the side elements 11, 12 at their widest portions 14. Thus, as shown in FIG. 4, when two such gears are assembled on a common shaft with their projecting hub portions abutting tightly, the two gears 50, 51 are spaced apart a distance sufficient to form a space for closely receiving the chain links 10.

As disclosed in the before mentioned Glickman U.S. application Ser. No. 072,271, the gears 50, 51 are drivingly connected to the shaft 52 by means of drive blocks 66, shown in FIGS. 9 and 10. The drive blocks 66 include body portions 67 and spaced apart, cantilevered gripping arms 69, 70 defining a gripping recess 68. Each of the gripping arms 69, 70 is formed with a locking projecting 72 which extends transversely with respect to the gripping arms. The location and spacing of the locking projections 72 is such that the drive block can be applied transversely over the longitudinally grooved body portion 55 of the shaft 52. The relative dimensioning of the parts is such that the drive block has to be forcibly applied, spreading apart the gripping arms 69, 70, until the locking projections 72 snap into longitudinal grooves 63 in the shaft element 52, as shown in FIG. 10. The drive block is then fixed to the shaft against rotation. In addition, while the drive block is movable longitudinally along the shaft, it grips it sufficiently tightly as to remain in any given position unless forcibly dislodged.

Figure 9:
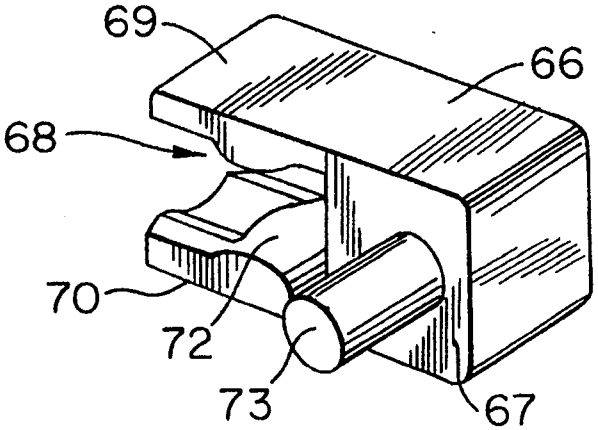
FIG. 9 is a perspective view of a drive block element employed for drivingly connecting the sprocket assembly to a shaft.
Figure 10:
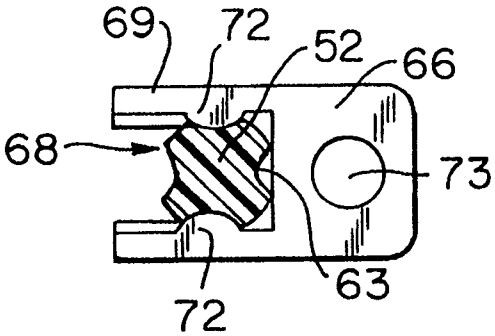
FIG. 10 is a cross sectional view as taken generally on line 10—10 of FIG. 4, showing the drive block element mounted on a shaft.

As reflected particularly in FIG. 9, each drive block carries an integral drive lug 73 which projects laterally from the block, so as to be parallel to the shaft 52 when the block is installed thereon. As shown in FIGS. 4 and 5, when the two gears 50, 51 are installed on the shaft 52, drive blocks 66 are snapped onto the shaft, to grip it tightly, and the drive blocks are pressed tightly against the gears to hold them with their hubs in butted relation. The toothed portions of the spur gears are kept separated by the projecting hubs 53.

Figure 2:
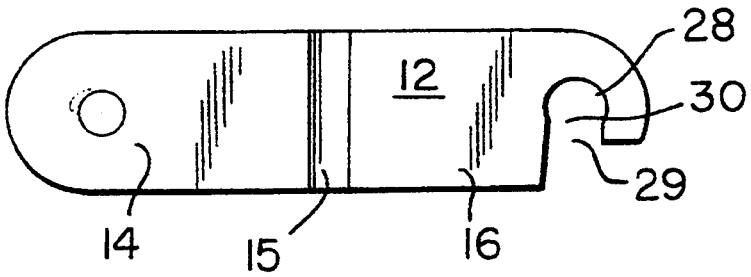
FIG. 2 is a side elevational view of the chain link of FIG. 1.
Figure 3:
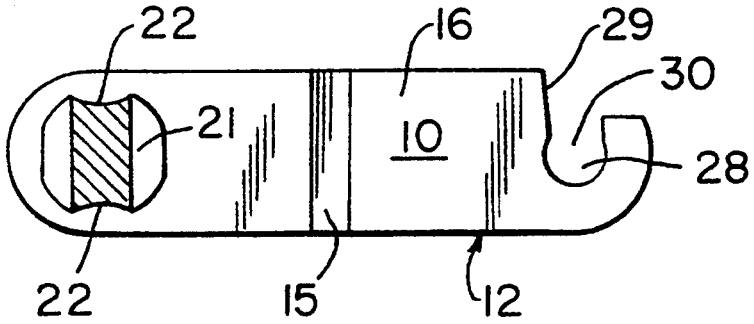
FIG. 3 is a cross sectional view as taken generally on line 3—3 of FIG. 1.

The hubs 53 are configured to have, on each side, cylindrical or partially cylindrical recesses 80 arranged on axes parallel to that of the hub opening 54 and spaced radially therefrom an appropriate distance to receive the drive lug 73 of a drive block mounted on the shaft. Accordingly, when the drive blocks are pressed tightly against the butted gears, as shown in FIG. 2, the drive lugs 73 are engaged in the openings 80. As a result, the gears 50, 55 are not only snugly positioned lengthwise on the shaft 52, but are positively fixed to the shaft against rotation.

As shown in FIG. 5, the spur gears 50, 51 are formed with peripheral gear teeth 82 defining recesses 81 therebetween. The spacing between the drive pins 26, 27 of one link from the corresponding drive pins of the next adjacent link is equal to the chordal distance between spaced-apart recesses 81 formed between the teeth 82 of the gears. In the illustrated arrangement, the drive pins are spaced apart a distance equal to the spacing between five gear teeth. Thus, when the assembled chain 40 is applied to a sprocket assembly 83, formed by the assembled gears 50, 51, the chain links are positively engaged with the gears by means of the drive pins 26, 27, and the links themselves are partially recessed within the space between the gears.

In a typical assembly, the chain assembly 40 is trained over at least two sprocket assemblies, one connected to a motor or other drive source (not shown), and the other being remotely driven. One or more intermediate idler or driven sprocket assemblies (not shown) may also be utilized, engaging the chain on either side.

Figure 8:
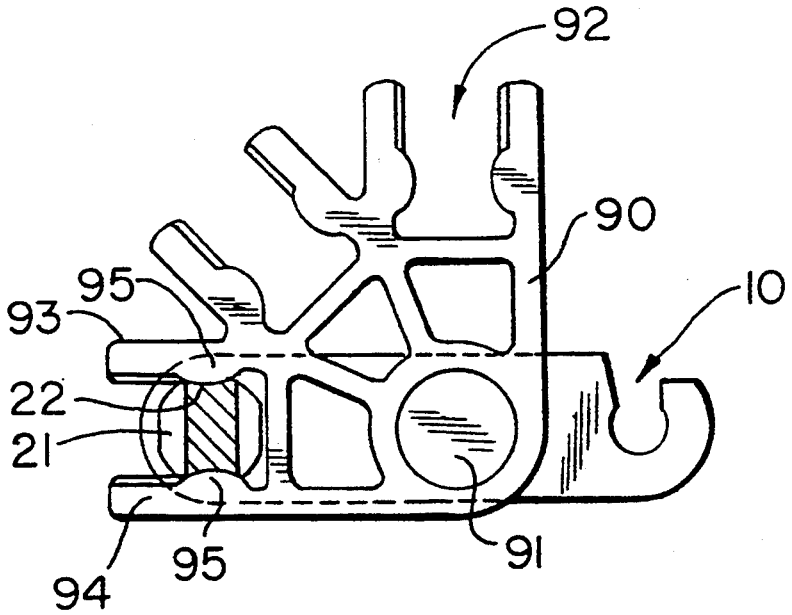
FIG. 8 is a cross sectional view, similar to FIG. 3, illustrating a connector element assembled to the chain link element.

To particular advantage, the grooved coupling elements 21 are adapted to be lockingly engaged, by a snap fit assembly, with connector elements of the construction toy system described in the before mentioned United States patents. In FIG. 8, an example of such a connector element is shown at 90. The connector element, described in more detail in the Glickman U.S. Pat. No. 5,199,919, includes a hub portion 91 and a plurality (three in the illustration) of gripping sockets 92 arranged in a radially spaced array with respect to the axis of the hub 91. Each of the gripping sockets includes spaced-apart gripping arms 93, 94 and transversely disposed locking projections 95. As more particularly described in the last-mentioned patent, each of the gripping sockets 92 is adapted primarily to receive by a lateral, snap-in assembly the annularly grooved end portion 56 of a strut-like element (see FIG. 11). The gripping sockets are also adapted, however, for a crosswise snap-fit assembly, in the same manner as the drive blocks 66 are assembled crosswise with the shaft 52 in the illustration of FIG. 4.

In the system of the present invention, the coupling element 21, formed in the base portion of each chain link 10, is transversely grooved at 22 for snap-fit assembly within one of the gripping sockets 92, with the locking projections 95 being snugly received within the transverse grooves 22 in the manner shown in FIG. 8 of the drawings. A connector element assembled to a chain link in the manner shown in FIG. 8 is rigidly oriented with the link, with a portion of the connector element projecting upward or downward from the chain link. The projecting portion of the connector element 90 may be used in a variety of ways, among which are to carry a wheeled vehicle up an incline in a roller coaster system, for example. The arrangement accommodates the attachment to selected chain links of a variety of parts (or assemblies of parts), as will be understood.

As indicated in FIGS. 4 and 5, there is substantial radial clearance space between the gear-supported chain links and the area occupied by the hub 53. Accordingly, devices connected to and carried by the chain links may project in either direction from the chain links, as long as the inward projection of the connected device is not sufficiently great as to contact the hub 53 when passing between the spaced-apart gear elements 50, 51 of the sprocket assembly.

The chain drive system of the invention is uniquely advantageously for use in a construction toy system, and particularly so in a system of the type described in the before mentioned Glickman U.S. patents. The individual links, precision injection molded of a structural plastic such as polypropylene, are extremely light in weight, so that an assembled chain of great length can be constructed without imposing excessive loads on a toy structure. A chain of any length can be easily and quickly assembled by snap fitting of links to each other in succession, to suit almost any requirement.

A feature of particular advantage is the arrangement by which the chain is supported and driven, utilizing a sprocket assembly formed by placing two gear elements, otherwise employed in the toy system for gear mechanisms, in butting contact, spaced-apart a distance to receive the chain links between two opposed gears, to form in effect a two-part sprocket, and using drive pins on the chain links, received between teeth of the gears, to form a desired drive connection with the sprocket.

The ability to incorporate into the chain system, one or more standard connector elements from the patented toy system, to provide projecting elements at selected points along the chain, adds another important function to the new chain drive system.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A chain drive for a construction toy system comprising a plurality of connected chain links, wherein each said chain link is a unitary molding of structural plastic material, of generally U-shaped configuration, and comprises (a) a pair of spaced-apart side elements, each having a base end portion and a projecting free end portion, (b) a base element extending between and integrally rigidly connecting said side elements adjacent said base end portions and holding said side elements in spaced-apart relation, (c) said base element including bearing portions of reduced cross section adjacent said side elements defining a pivot axis and forming spaced retaining grooves for guided reception of free end portions of a successive chain link, (d) bearing-engaging elements located in the projecting free end portions of each of said side elements and defining snap-in recess means for semi-permanently engaging with bearing portions of a successive chain link to provide for a pivot connection between successive chain links about the pivot axis defined by said bearing portions.

2. A chain drive according to claim 1, wherein (a) said bearing-engaging elements comprise generally circular openings in the projecting free end portions of each of said side elements, and (b) notches in said projecting free end portions communicating with said generally circular openings through throat areas of reduced dimension, whereby assembly of chain links requires said bearing portions to be forced through said throat areas.

3. A chain drive according to claim 1, wherein (a) pin-like drive elements, integral with said side elements and coaxial with said bearing portions, extend outwardly from said side elements, at each side of a chain link, for engagement with a sprocket device.

4. A chain drive according to claim 1, wherein (a) pin-like drive elements, integral with said side elements and coaxial with said bearing portions, extend outward from said side elements on opposite sides of said chain links for cooperation with a sprocket device, and (b) said chain drive further includes a sprocket device comprising a pair of spaced-apart sprockets, mounted for rotation in unison and having a space between them for receiving chain links, (c) said sprockets having peripheral recesses adapted for the reception of and driving engagement with said drive elements.

5. A chain drive according to claim 4, wherein (a) said sprockets comprise spur gear elements having spaced-apart peripheral gear teeth defining said peripheral recesses.

6. A chain drive according to claim 5, wherein (a) said spur gear include integral projecting hub portions extending laterally beyond said peripheral gear teeth, (b) said sprocket device comprising a pair of said sprockets mounted on a common shaft with their respective projecting hub portions in butting engagement to form a space between the peripheral gear teeth of the respective spur gears for the reception of chain links.

7. A chain drive for a construction toy system comprising a plurality of connected chain links, wherein each said chain link is a unitary molding of structural plastic material and comprises (a) a pair of spaced-apart side elements, each having a base end portion and a projecting end portion, (b) a base element extending between and rigidly connecting said side elements adjacent said base end portions and holding said side elements in spaced-apart relation, (c) said base element including bearing portions defining a pivot axis, (d) bearing-engaging elements located in the projecting end portions of each of said side elements and defining snap-in recess means for semi-permanently engaging with bearing portions of an adjacent chain link to provide for a pivot connection between adjacent chain links about the pivot axis defined by said bearing portions, (e) said bearing-engaging elements comprising generally circular openings in the projecting portions of each of said side elements, (f) notches in said projecting portions communicating with said generally circular openings through throat areas of reduced dimension, whereby assembly of chain links requires said bearing portions to be forced through said throat areas, (g) said bearing portions comprising generally cylindrical portions of said base element located between base portions of said side elements, whereby said bearing-engaging elements of one link of an assembly of links are confined within the side elements of an adjacent, connected link, and (h) said base portion including portions, located between said generally cylindrical bearing portions and of larger dimensions than said bearing portions, for confining said bearing engaging elements to said bearing portions.

8. A chain drive for a construction toy system comprising a plurality of connected chain links, wherein each said chain link is a unitary molding of structural plastic material and comprises (a) a pair of spaced-apart side elements, each having a base end portion and a projecting end portion, (b) a base element extending between and rigidly connecting said side elements adjacent said base end portions and holding said side elements in spaced-apart relation, (c) said base element including bearing portions defining a pivot axis, and (d) bearing-engaging elements located in the projecting end portions of each of said side elements and defining snap-in recess means for semi-permanently engaging with bearing portions of an adjacent chain link to provide for a pivot connection between adjacent chain links about the pivot axis defined by said bearing portions, (e) said base element including a coupling portion, located between said side elements, said coupling portion having opposed transverse locking grooves adapted for snap-in engagement with an external element.

* * * * *